United States Patent [19]

Hughes et al.

[11] 4,202,720

[45] May 13, 1980

[54] WEB CUTTING AND SPLICING APPARATUS

[75] Inventors: Theodore R. Hughes, Tulsa, Okla.; Glenn L. McCarty, 6319 S. 45 W. Ave., Tulsa, Okla. 74132

[73] Assignee: Glen L. McCarty, Tulsa, Okla.

[21] Appl. No.: 808,448

[22] Filed: Jun. 21, 1977

[51] Int. Cl.[2] ..... B26D 5/00

[52] U.S. Cl. ..... 156/353; 156/502; 242/56 R

[58] Field of Search ..... 156/502, 504, 506, 505, 156/353-355; 242/56 R, 56.1

[56] References Cited

U.S. PATENT DOCUMENTS

| | | | |
|---|---|---|---|
| Re. 23,875 | 9/1954 | Speed et al. | 156/505 X |
| 3,127,122 | 3/1964 | Rosheind | 242/56 R |
| 3,495,782 | 2/1970 | Nelson et al. | 242/56 R |
| 3,580,522 | 1/1971 | Hansen et al. | 242/56 R |
| 3,603,522 | 9/1971 | Herrmann | 242/56 R |
| 3,693,900 | 9/1972 | Bohn | 156/506 X |
| 3,827,647 | 8/1974 | Jores et al. | 242/56 R |

*Primary Examiner*—David A. Simmons
*Attorney, Agent, or Firm*—Head & Johnson

[57] ABSTRACT

A web cutter and splicer for cutting a continuous web of material into relatively short lengths and winding the cut lengths onto a storage roll and which comprises a pulley for initially receiving the continuous moving web thereover and a solenoid actuated clamping or holding device for receiving the web from the pulley and intermittently holding the web against movement. The web also moves through a solenoid actuated cutting apparatus operably connected for actuation when the clamping device is actuated whereby the web is severed at a preselected position in order that the severed portion of the web may be wound on the storage roll.

9 Claims, 6 Drawing Figures

WEB CUTTING AND SPLICING APPARATUS

BACKGROUND OF THE INVENTION

1. Field of the Invention

This invention relates to improvements in cutting and splicing devices and more particularly, but not by way of limitation, to a device for cutting a continuous web of material into relatively short pieces and winding the short pieces onto a storage roll.

2. Description of the Prior Art

In many instances it is desirable to sever a continuously moving web of material into relatively short predetermined lengths whereby the severed short lengths may be wound onto a suitable storage roll for facilitating handling of the material. For example, in the movie industry, the houses wherein a movie is to be shown normally receives the film as stored on a plurality of film reels each having approximately two thousand feet of film wound or stored thereon. The plurality of short lengths of film must be spliced together into a single continuous strip or web for projection thereof with the usual movie projection equipment. When the "run" of the movie at one particular movie house has expired and the film is to be shipped or transported to the next movie house wherein the film is to be shown, the continuous strip of film must be cut apart into lengths of approximately two thousand feet and rewound of the storage reels for shipment. Normally this procedure requires that the movie house personnel, such as the projectionist, remain after the last showing of the film for approximately three hours, depending, of course, on the length of the entire movie contained on the film strip, for running the film through the usual presently available apparatus for cutting the film into the desired lengths and rewinding the two thousand foot lengths of film onto the shipping reels. The disadvantages of this method and means of cutting the continuous film strip into the required shorter lengths and rewinding the severed film sections onto the shipping reels will be apparent.

SUMMARY OF THE INVENTION

The present invention contemplates a novel apparatus for substantially automatically cutting a continuous web into preselected lengths and winding the severed lengths of thematerial onto suitable storage rolls. In the movie industry, as hereinbefore set forth, the continuous film strip may be cut into the desired shorter lengths and rewound onto the storage reels simultaneously with the last showing of the film at the movie house, thus greatly reducing the time the personnel must remain subsequent to the last showing of the film for preparing the film for shipment. The novel apparatus comprises a first pulley for receiving the continuous moving web thereover and directing the web into and through a clamping or holding device, a cutting device, and onto a storage roll. The clamping or holding device is preferably actuated by a suitable solenoid which is responsive to a signal received from the moving web for intermittently momentarily stopping the movement of the web. The cutting device is also preferably actuated by a solenoid simultaneously with the actuation of the clamping device for severing the continuous web and freeing the severed portion from the remaining web, thus providing a preselected length of the web on the storage roll. The cutting device also adheres the newly cut end of the remaining portion of the web to a leader of an empty storage roll whereby the moving web beings to wind onto the new storage roll. The operation may be repeated until the entire web has been cut into the desired lengths and wound onto a plurality of storage rolls. The novel cutting and splicing apparatus is simple and efficient in operation and economical and durable in construction.

DESCRIPTION OF THE PREFERRED EMBODIMENT

Figure 1:
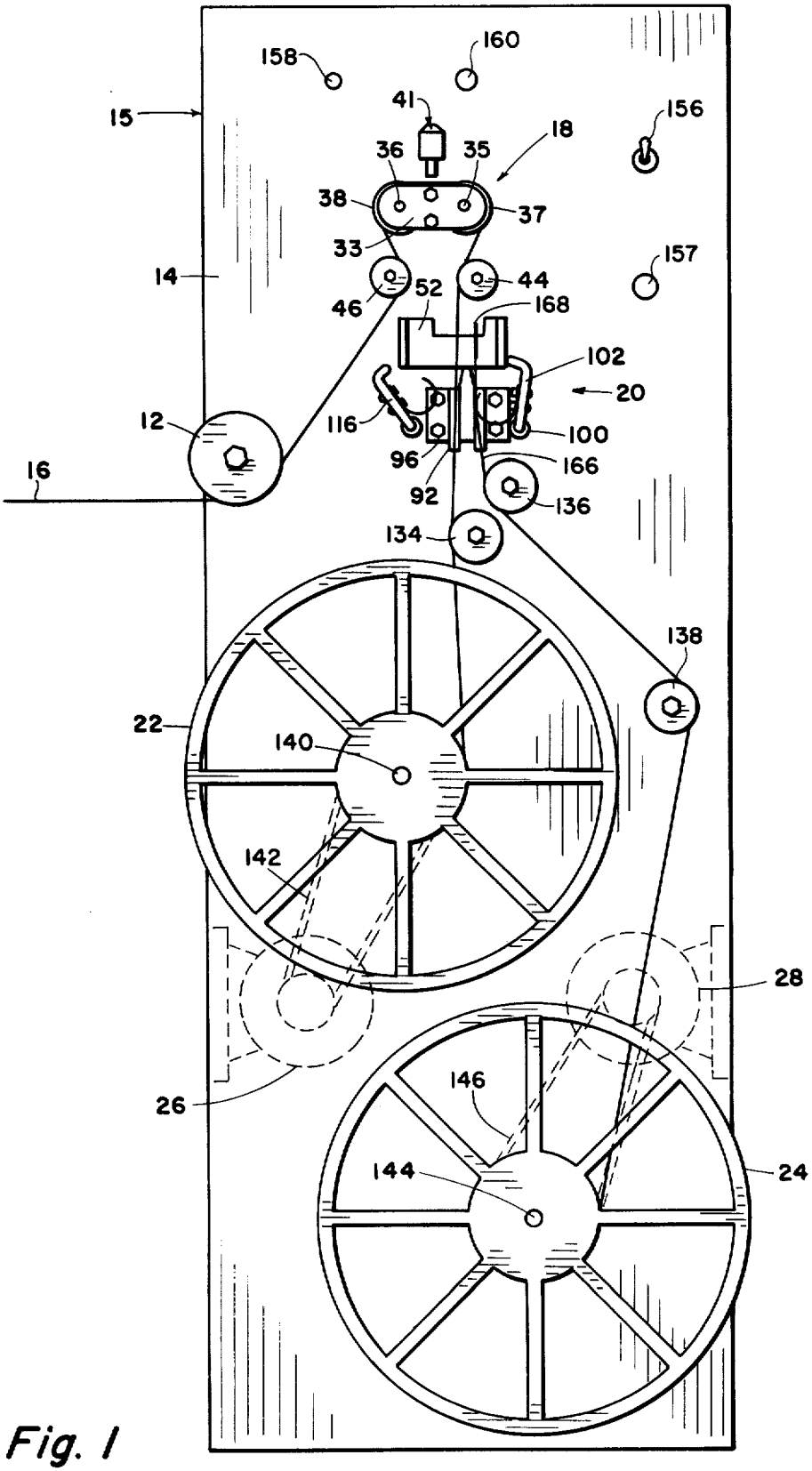
FIG. 1 is a front elevational view of a web cutting and splicing apparatus embodying the invention.

Referring to the drawings in detail, reference character 10 generally indicates a web cutting and splicing apparatus comprising a pulley 12 suitably journalled on a support wall 14, or the like, of a suitable housing 15, for initially receiving a substantially continuously moving web 16 therearound. The web 16 may be any suitable material, such as fabric, movie film, or the like. A braking or clamping apparatus generally indicated at 18 is suitably mounted on the support wall 14 in spaced relation from the pulley 12 for receiving the travelling web 16 therethrough for a purpose and in a manner as will be hereinafter set forth. A cutting apparatus generally indicated at 20 is mounted on or carried by the support wall 14 in spaced relation with respect to the braking apparatus 18 and also receives the travelling web 16 therethrough. It is preferable to provide at least two take-up or storage reels as shown at 22 and 24 in FIG. 1 and which are suitably journalled on the wall 14 in mutually spaced relationship and in spaced relation to the cutting apparatus 20. The reels 22 and 24 are each driven by an independent motor 26 and 28, respectively, and alternately receiving the web 16 thereon for moving the web 16 from the pulley 12 to the respective reel in a manner and for a purpose as will be hereinafter set forth.

Figure 2:
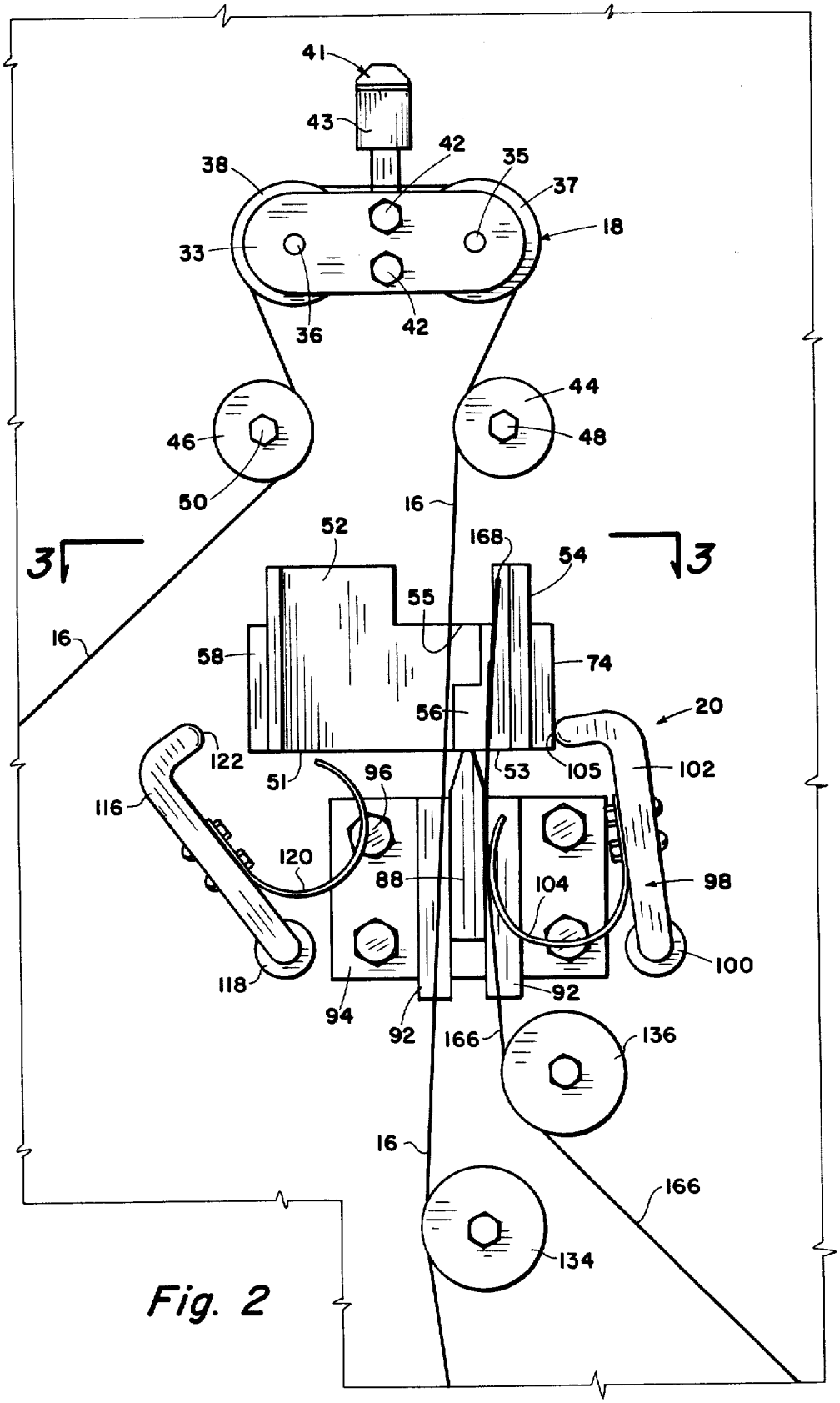
FIG. 2 is an enlarged front elevational view of the clamping and cutting devices of a web cutting and splicing apparatus embodying the invention.
Figure 4:
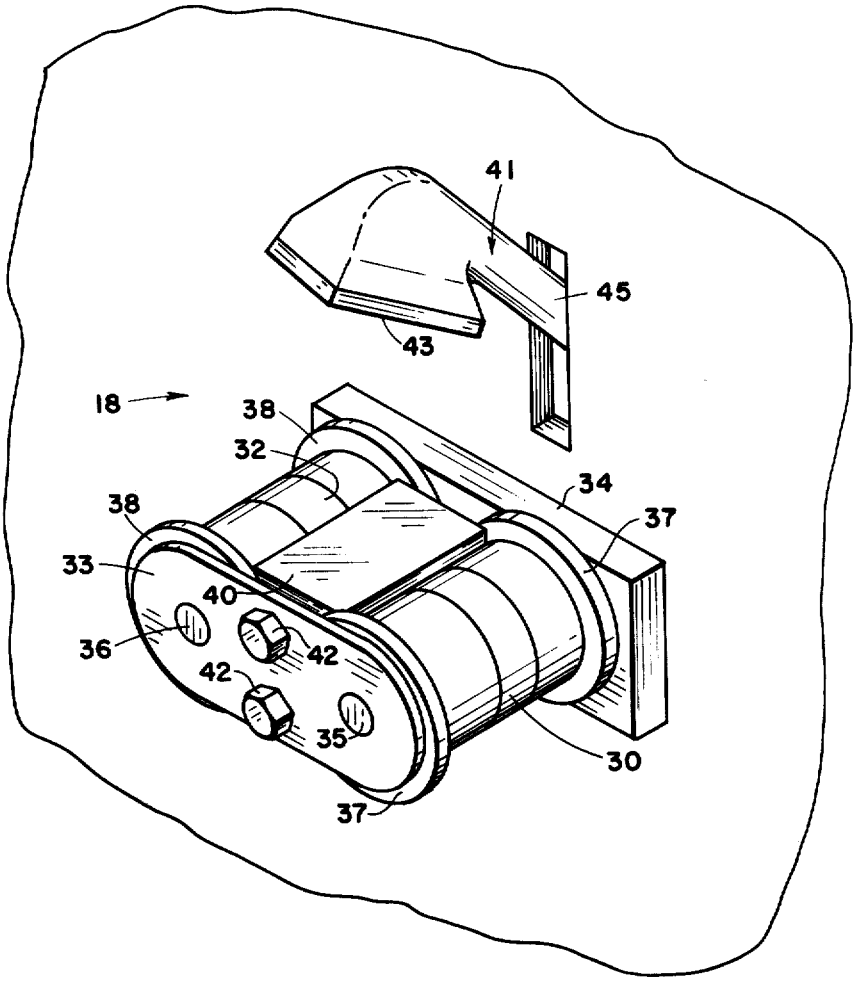
FIG. 4 is a perspective view of the clamping device utilized on a web cutting and splicing apparatus embodying the invention.

Referring now more particularly to FIGS. 2 and 4, the braking apparatus 18 comprises a pair of spaced spools or sensing rollers 30 and 32 journalled between a bracket 33 and a mounting plate 34 for free rotation about the respective axes 35 and 36 thereof. The mouting plate 34 may be bolted or otherwise secured to the wall 14 in such a manner that the rollers 30 and 32 extend outwardly therefrom at substantially right angles for receiving the web 16 thereover. The spools or rollers 30 and 32 are preferably provided with outwardly extending circumferential flanges 37 and 38 at the opposite ends thereof for facilitating retaining of the web 16 in position on the respective roller. A spacer block 40 is interposed between the rollers 30 and 32 and is suitably secured to the mounting plate 34 in any well-known manner, such as by bolts 42, and the web 16 passes over or across the upper face of the block 40 as clearly shown in FIG. 4.

A pair of substantially identical idler rollers 44 and 46 are journalled on the wall 14 in any well-known manner for free rotation about the respective axes 48 and 50 thereof. The idler 44 is interposed between the roller 30 and the cutting apparatus 20 and receives the web 16 around the inwardly directed outer peripheral portion thereof as shown in FIG. 2 for maintaining tension between the web 16 and the roller 30 for assuring that the web will always be in intimate contact with the roller 30 during operation of the apparatus 10. Similarly, the idler 46 is interposed between the roller 32 and the first pulley 12 for receiving the web 16 around the inwardly directed outer peripheral portion thereof for assuring that the web 16 will always be in intimate contact with the roller 32 during operation of the apparatus 10.

A brake or clamp member 41 is disposed in substantial alignment with the block member 40 and comprises a head member 43 carried by a pivotal lever member 45 which extends through an elongated aperture or slot 47 provided in the wall 14. The outer end (not shown) of the lever 45 is pivotally secured to the actuator arm of a suitable solenoid 47 (FIG. 6) which may be mounted on the reverse side of the wall 14 in any suitable manner (not shown). The head member 43 is normally in a raised position with respect to the block 40, as shown in FIGS. 2 and 4 and is moved into a position of engagement with the block 40 when the solenoid 47 is is activated, as will be hereinafter set forth. Of course, when the head member 43 is in engagement with the block 40, the web 16 extending across the block 40 will be securely clamped therebetween for momentary stopping of the movement of the web 16.

Figure 3:
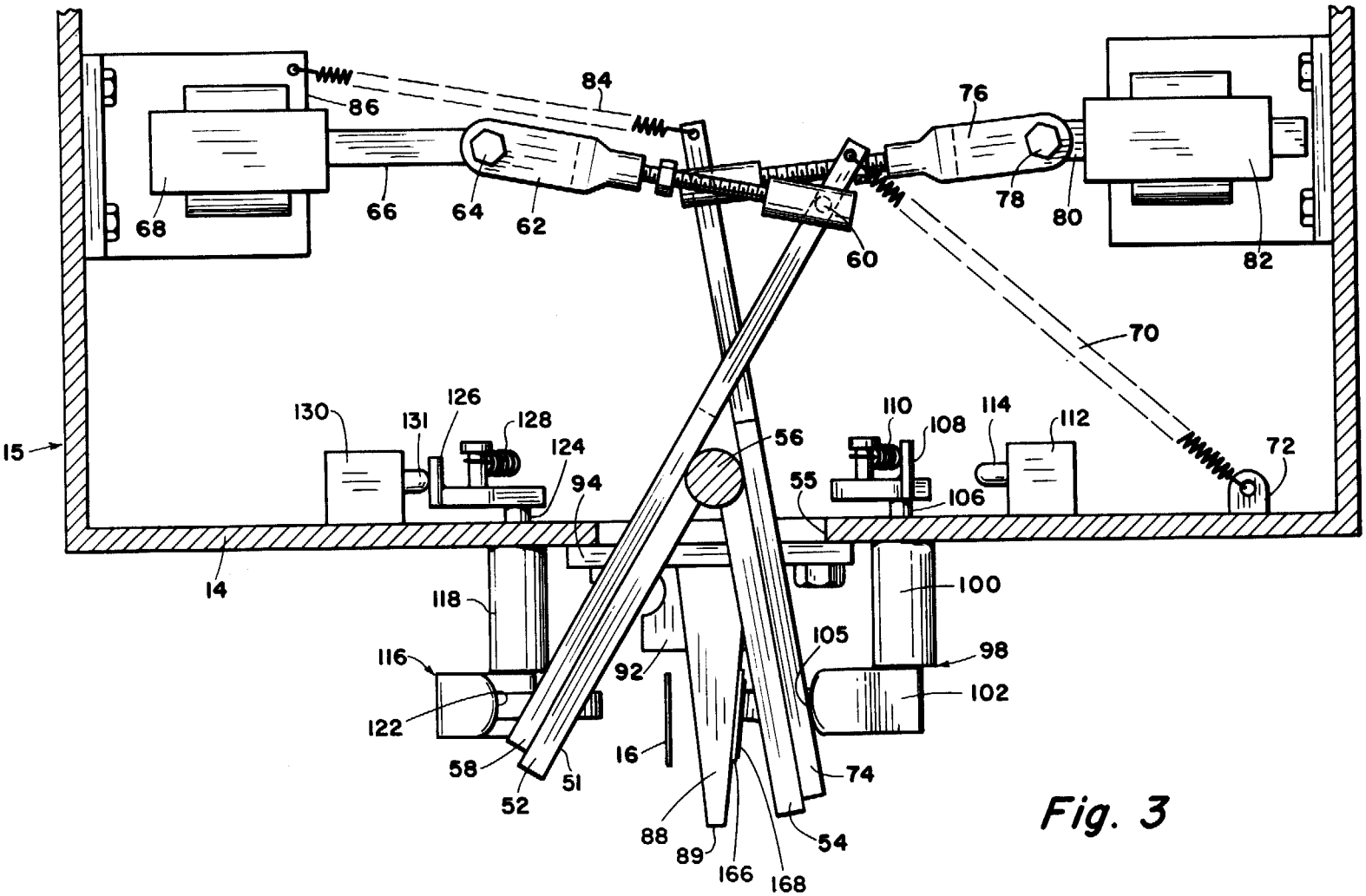
FIG. 3 is a sectional view taken on line 3—3 of FIG. 2.

Referring now to FIGS. 2 and 3, the cutting apparatus 20 comprises a pair of pivotal cutting arms 52 and 54 having the inwardly directed ends thereof extending through an opening 55 in the wall 14 and secured together by a suitable hinge member 56. The lower edge of each arm 52 and 54, as viewed in the drawing, is provided with a cutting edge or element 51 and 53, respectively. An actuator arm 58 is suitably secured to the outer face of the cutting arm 52 and extends through the opening 55 for pivotal connection at 60 with a suitable lever 62 which in turn is pivotally connected at 64 with the reciprocal actuator arm 66 of a solenoid 68. In addition, the inner end of the actuator arm 58 is secured or anchored to one end of a suitable helical spring 70, said spring 70 having the opposite end thereof anchored to a lug or bracket member 72 secured to the inner surface of the wall 14. The spring 70 constantly urges the actuator arm 58 in a clockwise direction about the pivot connection 60, as viewed in FIG. 3 for providing a normal position for the arm 52 spaced from the cutting arm 54.

An actuator arm 74 similar to the arm 58 is secured to the outer face of the cutting arm 54 and extends through the opening 55 into pivotal connection with a lever arm 76 which in turn is pivotally secured at 78 to the actuator arm 80 of a solenoid 82. The inner end of the actuator arm 74 is secured or anchored to one end of a suitable helical spring 84 which has the opposite end thereof anchored to a lug or bracket member 86 which is secured to the inner periphery of the housing 15 in any well-knwon manner (not shown). The spring member 84 constantly urges the actuator arm 74 in a counterclockwise direction about the pivotal engagement point thereof with the lever 76 for providing a normal position for the clamp arm 54 out of engagement with the cutting arm 52. In addition, it is preferable that the solenoid 68 be of a type wherein the normal position of the actuator arm 66 thereof is extended as shown in FIG. 3, and the solenoid 82 be of the type wherein the normal position of the actuator arm 80 thereof is contracted.

A vertically disposed cutting block member 88, as viewed in the drawings, is disposed below the cutting arms 52 and 54 in substantial alignment with the hinge member 56 and is disposed in such a manner that there is a slight clearance between the cutting elements 51 and 53 and the upper end 89 of the block 88 when the cutting arms 52 and 54 are moved in directions toward each other, as will be hereinafter set forth. The block 88 is suitably secured between a pair of spaced holding elements 90 and 92, which are, in turn, suitably secured to a mounting plate 94, or otherwise secured thereto. The web 16 extends from the idler 44 through or between the cutting arms 52 and 54 and along one or the other side of the block 88 during operation of the apparatus. For example, when the web 16 is being reeled or wound onto the reel 22 as shown in FIGS. 1 and 2, the web 16 passes along the left-hand side of the block 88 as viewed in the drawings. When the web 16 is being wound onto the reel 24, the web passes along the right-hand side of the block 88 (this position not shown in the drawings).

Another holding element 98 is pivotally secured to the wall 14 by a suitable journal member 100 and comprises a substantially inverted L-shaped body member 102 having a leaf spring 104, or the like, bolted or otherwise secured to the inwardly directed surface thereof. In one pivotal position of the holding element 98, the leaf spring 104 is in yieldable engagement with the right-hand face of the block 88 and the outer end 105 of the body is in engagement with the outer surface of the arm 74. In another pivotal position of the element 98, the leaf spring 104 is out of engagement with the block 88 and the end 105 is out of engagement with the arm 74. The axis 106 of the journal extends through an aperture (not shown) in the wall 14 and is rotatable with respect thereto. A contactor arm 108 is secured to the inwardly directed end of the axis 106 and is biased or spring urged by a helical overload spring 110 anchored between the arm 108 and housing 15 in any suitable manner. When the holding element 98 is in engagement with the arm 74, the spring 110 holds the end 105 firmly in engagement therewith as well as assures that the leaf spring 104 will be in engagement with the block 88. When the arm 74 is actuated in a manner as will be hereinafter set forth for moving in a direction away from the arm 58, the body 102 is pivoted about the journal 100 and simultaneously rotates the contact arm 108 in a corresponding direction toward a suitable switching apparatus 112 secured to the inner face of the wall 14 in the proximity of the arm 108. When the contact arm 108 is moved sufficiently for passing "dead center" of the rotational axis thereof, the spring 110 then functions for moving the arm 108 into engagement with the switch arm 114 of the switching apparatus 112 for actuation of the switch 112. The switch 112 is operably connected with one of the motors, such as the motor 28, for intermittent actuation thereof as will be hereinafter set forth in detail.

A holding element 116, substantially identical to the holding element 98 but oppositely disposed with respect thereto is similarly pivotally secured to the housing 15 by a suitable journal 118 and carries a leaf spring 120 on the inwardly directed face thereof for alternately engaging the left-hand side of the block 88. It is to be noted that the leaf spring 120 does not engage the block 88 when the leaf spring 104 is in engagement with the block, and similarly, the spring 104 does not engage the block 88 when the spring 120 is in engagement with the block. The holding element 116 is also substantially L-shaped, and the outer end 122 thereof is adapted for engagement with the outer surface of the arm 58 in the same manner and for the same purpose as the end 105 of the body 102. The axis 124 of the journal 118 extends through an aperture (not shown) in the wall 14 and is suitably secured to a contact arm 126 which is substantially identical to the contact arm 106 and rotates simultaneously with the axis 124. The arm 126 is biased or spring urged by a suitable helical spring 128 which is anchored between the arm 126 and housing 15 in any well-known manner. As hereinbefore set forth in connection with the operation of the holding element 98, in one pivotal position of the holding element 116, the end 122 is in engagement with the arm 58 and the leaf spring 120 is in engagement with the block 88; and in another pivotal position of the element 116, the element 116 and spring 120 are out of engagement with the arm 58 and block 88, respectively. When the element 116 is pivoted by the pivotal movement of the arm 58 and through a sufficient distance, the contact arm 126 passes over the "dead center" position therefor, and the spring 128 moves the contact arm 126 into engagement with a switching apparatus 130 which is secured on the inner face of the wall 14 in the proximity of the arm 126. The arm 126 engages the switch arm 132 of the switching apparatus 130 for actuation thereof. The switching apparatus 130 is operably connected with the other motor, such as the motor 26, for intermittent actuation thereof as will be hereinafter set forth.

It is preferable to provide a plurality of idler rollers interposed between the cutting apparatus 20 and the reels 22 and 24 for facilitating the movement of the web 16 onto the reels. As particularly shown herein, a first idler roller 134 is suitably journalled on the wall 14 in the proximity of the outer periphery of the reel 22 and substantially vertically spaced from the block 88. The web 16 passes over the left-hand side of the idler 134 as shown in FIGS. 1 and 2, and onto the reel 22 for winding onto the reel 22, as will be hereinafter set forth. A second idler roller 136 is suitably journalled on the wall 14 in spaced relation to the idler 134 and preferably disposed slightly to one side of the block 88 for receiving the web 16 around the left-hand side thereof when the web is winding onto the reel 24 (a condition not shown in the drawings). In addition, a third idler roller 138 is suitably journalled on the wall 14 interposed between the reel 24 and the idler 136 for receiving the web 16 around the right-hand side thereof as the web 16 passes from the idler 136 to the reel 24. Of course, any suitable number and arrangement of idlers may be utilized as desired for facilitating the transporting of the web 16 to either the reel 22 or the reel 24.

The reel 22 is carried by a suitable axle 140 which extends rotatably through an aperture (not shown) in the wall 14. The axle 140 is operably connected with the drive shaft (not shown) of the motor 26 in any suitable manner for rotation thereby. As particularly shown in FIG. 1, an endless belt or chain 142 may extend between a suitable gear train or pulley arrangement carried by the motor drive shaft and the axle 140, as is well known. The reel 24 is carried by a suitable axle 144 which also extends rotatably through an aperture (not shown) in the wall 14. The axle 144 is operably connected with the drive shaft (not shown) of the motor 28 in any suitable manner for rotation thereby. As shown in FIG. 1, an endless belt or chain 146 may extend between a suitable gear train or pulley arrangement carried by the motor drive shaft and the axle 144, as is well known.

Figure 6:
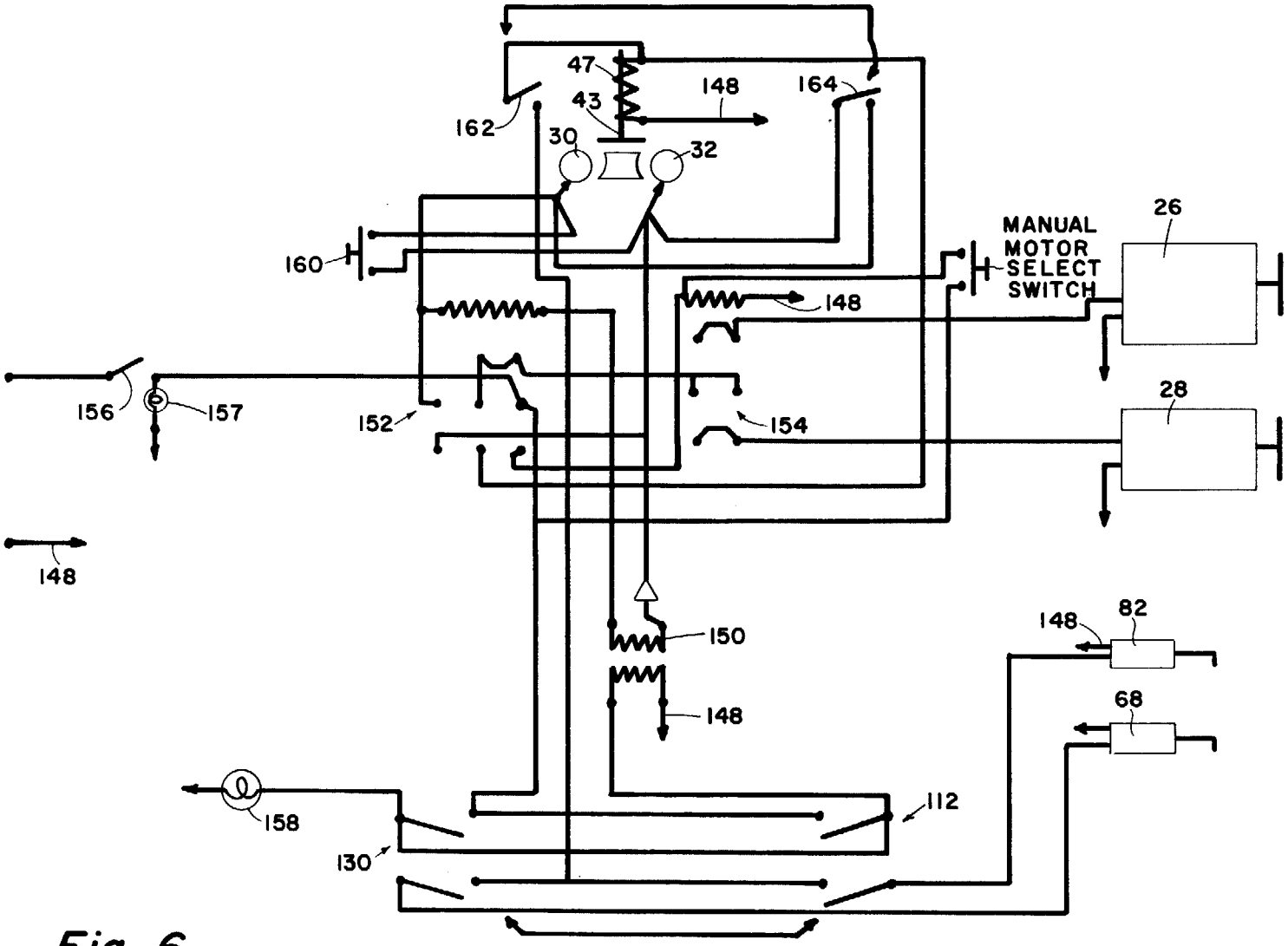
FIG. 6 is a schematic view of an electrical circuit for a web cutting and splicing apparatus embodying the invention.

The power for operation of the apparatus 10 may be the usual or standard 110 AC house current as indicated at 148 in FIG. 6, and it is preferable to provide a suitable 12-volt DC power supply 150 in connection with the source 148 for supplying suitable power for the sensing rollers 30 and 32. The switching devices 112 and 130 are preferably connected with the respective motors 26 and 28 through suitable relays generally indicated at 152 and 154. The solenoids 68, 82, and 148 as well as the motors 26 and 28 are preferably operably connected with the current source 148. It is also preferable to provide a master switch 156 and pilot light 157 operably connected with the relays, and a suitable ready light 158 operably connected with the switch devices 112 and 130. A manual override switch 160 is also provided in the system for manual operation of the apparatus 10 in the event the automatic operation thereof fails for some reason. Of course, suitable switches 162 and 164 are operably connected between the brake solenoid 148 and the sensing rollers 30 and 32 as well as the switches 112 and 130 for synchronized actuation of the braking apparatus 18 and the cutting apparatus 20 and the actuation of the motors 26 and 28.

In operation, assuming that the web 16 is movie film, the web 16 must be initially threaded through the apparatus 10 by passing the leading end of the web 16 around the pulley 12, through the clamping or braking apparatus 18, through the cutting apparatus 20, and onto one of the reels, such as the reel 22. The reel 22 will now be the driven or powered take-up reel during the initial operation of the apparatus 10. A second reel, such as the reel 24, which is empty, is installed on the shaft 144 in any well-known manner, and the usual leader 166 normally provided with a reel of this type of equipment is directed over the idler 138 and under the idler 136 in such a manner that the free end of the leader 166 is inserted into the cutter apparatus 20 and positioned against the right-hand side of the block 88 and against the inner face of the arm 54. A suitable length of double-faced pressure sensitive tape 168 is adhered to the extreme outer end of the leader 166 and is disposed in the proximity of the inner face of the arm 54. The holding element 98 is positioned in such a manner that the leaf spring 104 is in yielding engagement with the block 88 for holding the leader 166 securely thereagainst. In this position of the element 98, the contact arm 108 is not in engagement with the switching apparatus 112, and the motor 28 is inactive. At the same time, the holding element 116 is positioned in such a manner that the contact arm 126 is in engagement with the switching apparatus 130, thus placing the motor 26 in the electric circuit of the apparatus 10.

When the master switch 156 is manually closed, power is transmitted to the apparatus 10, and the motor 26 begins the rotation of the reel 22 for pulling the web 16 through the apparatus 10. As hereinbefore set forth, assuming that the web 16 is movie film as shown at 170 in FIG. 5, a suitable length of magnetic material 172 is glued or otherwise adhered to the film strip 170 at preselected intervals, such as every two thousand feet along the entire length thereof. The material 172 is adhered to the proper side of the film 170 whereby the underside thereof as the film passes over the sensing rollers 30 and 32 carries the magnetic material. As the magnetic material 172 passes across the sensing rollers 30 and 32, the braking solenoid 47 is activated for closing the switches 162 and 164 and moving the head member 43 into engagement with the block 40 for clamping the film strip 16 momentarily therebetween. Simultaneously with the activation of the solenoid 47, the soldnoid 82 of the cutting arm 52 will be activated for moving the arm 52 in a direction toward the arm 54. As the cutting element 51 moves across the outer tip 89 of the block 88, the film 16 will be severed and released from connection with the remaining portion of the film strip. The arm 52 continues to move and engages the arm 54, carrying with it the free end of the remaining film strip. The pressure of the engagement of the arm 52 with the arm 54 adheres the cut end of the film strip to the tape of the leader 166, thus connecting the remaining portion of the film strip 16 to the leader 166.

As the arm 52 is moved in the direction toward the arm 54, the connector arm 126 is moved away from the switch arm 132, thus deactivating the motor 26. Of course, the arm 54 is moved in a direction for moving the holding element 98 in a manner for bringing the connector arm 106 into engagement with the switch arm 114 and energizing or activating the motor 28 whereby the reel 24 now becomes the driving force for moving the strip 16 through the apparatus.

As soon as the cutting and switching operation has been accomplished, the braking apparatus is deenergized and the pressure against the film 16 on the block 40 is released wherein the continuous movement of the film may be restored. It is to be noted that the stoppage of the movement of the web 16 is momentary and causes substantially no effect in the overall forward movement of the web. However, in the event any slack occurs in the web 16 upstream of the braking apparatus 18 during a cutting operation, suitable pinch rollers, or the like (not shown) may be provided for compensating for any such slack, as is well known.

When the solenoids are deactivated, the springs 70 and 84 return the cutter arms 52 and 54 to their normal disengaged position, and the operation may be repeated until the entire continuous length of the web 16 has been divided or separated into a plurality of lengths of substantially any desired dimension.

When the reel 22 has been filled with the desired length of web 16 in the manner hereinbefore set forth, the reel may be manually removed from the apparatus 10 and a new or empty reel may be substituted therefor. The leader of the newly installed reel may be threaded into the cutter apparatus 20 in the manner as hereinbefore set forth, and the operation of the apparatus may be continued for winding a plurality of reels with the predetermined lengths of the web material. Of course, in the event the sensing rollers do not detect a material length 172 or if there is any other reason for cutting the web at a point wherein the clamping apparatus 18 and cutting apparatus 20 do not automatically function, the override switch 160 may be utilized in the usual manner for manual operation of the apparatus 10.

Figure 5:
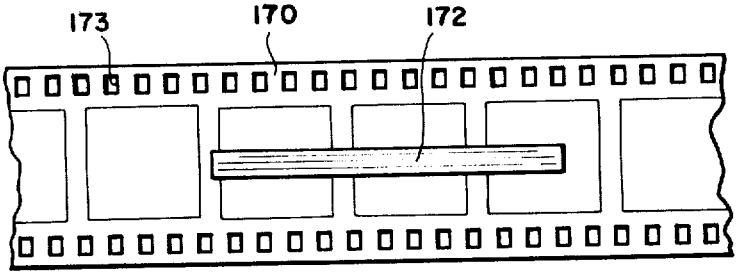
FIG. 5 is a plan view of a portion of a web or strip of material such as utilized in combination with a cutting and splicing apparatus embodying the invention.

As hereinbefore set forth, the time period of the interruption of the movement of the web 16 by the clamping thereof between the block 40 and the head 43 of the lever 45 is momentary and in fact is almost undetectable by visual observation of the operation of the apparatus 10. Accordingly, in some instances it may be desirable to eliminate the lever 45 and block 40 entirely and sever or cut the web 16 without interruption of the longitudinal movement thereof. In this event, the sensing rollers 30 and 32 may be operably connected with the cutting apparatus 20 for direct actuation thereof upon the sensing of the passage of the magnetic element 172 across the rollers 30 and 32. In addition, it is to be noted that whereas the strip or element 172 as shown in FIG. 5 is disposed substantially along the longitudinal centerline of the film 170, there is no intention of limiting the invention to this particular transverse disposition of the element 172. In many instances it may be desirable to install the element 172 in the proximity of one edge of the web 16. Of course, in use in combination with the film 170, it is usually preferable to avoid interference between the strip 172 and the usual perforations 172 normally provided on the opposite edges of the film strip 170.

From the foregoing, it will be apparent that the present invention provides a novel web cutting and splicing apparatus wherein a substantially continuously moving web may be severed into a multitude of smaller length of predetermined dimensions, and winding the smaller length onto a storage roll. The novel device automatically senses a predetermined position in the overall length of the continuous web and momentarily stops the forward movement of the web whereby a cutting apparatus automatically cuts the web and adheres the outer end of the remaining web to a leader of a new or empty storage roll, whereby the winding operation may be continued until the entire web has been divided into the desired shorter lengths.

Whereas the present invention has been described in particular relation to the drawings attached hereto, it should be understood that other and further modifications, apart from those shown or suggested herein, may be made within the spirit and scope of this invention.

What is claimed is:

1. Web cutting and splicing apparatus comprising pulley means for initially receiving the web therearound, braking means spaced from the pulley means for receiving the web therethrough, at least one actuator cooperating between the web and the braking means for selective actuation of the braking means to momentarily hold the web against longitudinal movement, cutting means spaced from the braking means for receiving the web therethrough, means operably connected with the cutting means for actuation simultaneously with the braking means for severing the web at a predetermined position thereon, first reel means spaced from the cutting means for receiving the leading end of the web thereon, first power means operably connected with the first reel means for selective rotation thereof to move the web from the pulley means to the first reel means for winding the web thereon, second reel means journalled in spaced relation to the first reel means, second power means operably connected with the second reel means for selective rotation thereof, means operably connected between said first and second power means for alternate actuation thereof, means cooperating between said second reel means and the cutting means for splicing the leading end of the severed web to a leader provided on the second reel means for transferring the winding of the web from the first reel means to the second reel means, and means cooperating between the first and second power means for stopping the actuation of the first power means upon the severing of the web and simultaneously starting the actuation of the second power means.

2. Web cutting and splicing apparatus as set forth in claim 1 wherein the braking means comprises sensing roller means for receiving the web thereover, brake arm means movably secured in the proximity of the sensing roller means, said brake arm means responsive to the sensing action of the sensing roller means for intermittently engaging the web moving over the sensing roller means for momentarily stopping the longitudinal movement thereof.

3. Web cutting and splicing apparatus as set forth in claim 2 wherein the sensing roller means comprises a pair of spaced sensing rollers responsive to a sensor means carried by the web, block means interposed between the sensing rollers and in substantial alignment with the brake arm means whereby the brake arm means engages the block means in the engaged position of the brake arm means for momentarily clamping the web between the brake arm means and block means.

4. Web cutting and splicing apparatus as set forth in claim 2 and including idler means cooperating between the web and the sensing roller means for assuring an efficient contact between the web and the sensing roller means.

5. Web cutting and splicing means as set forth in claim 1 wherein the cutting means comprises cooperating cutting arm means having a normal open position for receiving the web therethrough, actuator arm means secured to the cutting arm means and operably connected with the actuator means for moving the cutting arm means to a closed position upon the momentary stoppage of the movement of the web, cutting element means carried by the cutting arm means and engagable with the web as the cutting arm means is moved toward the closed position for severing the web at a predetermined position.

6. Web cutting and splicing means as set forth in claim 5 wherein the cutting arm means comprises a first cutting arm hingedly secured to a second cutting arm and spring means anchored to each cutting arm for maintaining the normal open position for the cutting arm means.

7. Web cutting and splicing means as set forth in claim 1 wherein the last-mentioned means includes first pivotal lever means alternately engagable with the cutting means and first power means, second pivotal lever means alternately engagable with the cutting means and the second power means, spring means cooperating with the first and second pivotal lever means for retaining one pivotal lever in engagement with the cutting means simultaneously with retaining the other pivotal lever out of engagement with the cutting means whereby only one power means is actuated at a time.

8. Web cutting and splicing means as set forth in claim 7 wherein each pivotal lever means is provided with leaf spring means engagable with the cutting means when the pivotal lever is in engagement therewith for facilitating the transfer of the winding of the web from the first reel means to the second reel means.

9. Web cutting and splicing apparatus comprising pulley means for initially receiving the web therearound, braking means spaced from the pulley means for receiving the web therethrough, sensing means spaced from the pulley means for receiving the web thereacross, cutting means spaced from the braking means for receiving the web therethrough, at least one actuator cooperating between the web and sensing means for selective actuation of the cutting means for severing the web at a pre-determined position therealong, reel means spaced from the cutting means and having a leader secured thereto for receiving the leading end of the web thereon, power means operably connected with the reel means for selective rotation thereof to move the web from the pulley means to the reel means for automatically winding the web thereon, and wherein the reel means and power means comprise first reel means spaced from the cutting means for receiving the leading end of the web thereon, first power means operably connected with the first reel means for selective rotation thereof to move the web from the pulley means to the first reel means for winding the web thereon, second reel means journalled in spaced relation to the first reel means, second power means operably connected with the second reel means for selective rotation thereof, means operably connected between the first and second power means for alternate actuation thereof, means cooperating between said second reel means and cutting means for securing the leading end of the severed web to the second reel means for transferring the winding of the web from the first reel means to the second reel means, and means cooperating between the first and second power means for stopping the actuation of the first power means upon the severing of the web and simultaneously starting the actuation of the second power means.

* * * * *